US010570628B2

(12) United States Patent
Gomo et al.

(10) Patent No.: US 10,570,628 B2
(45) Date of Patent: Feb. 25, 2020

(54) ELEVATOR TRENCH DRAIN

(71) Applicant: Zurn Industries, LLC, Milwaukee, WI (US)

(72) Inventors: David M. Gomo, Lake City, PA (US); Robert A. DiPlacido, Erie, PA (US); Jaroslaw J. Plachotnik, Jamestown, NY (US); Jason E. Morris, Erie, PA (US)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 0 days.

(21) Appl. No.: 16/271,324

(22) Filed: Feb. 8, 2019

(65) Prior Publication Data

US 2019/0169860 A1 Jun. 6, 2019

Related U.S. Application Data

(63) Continuation of application No. 15/689,896, filed on Aug. 29, 2017, now Pat. No. 10,240,351, which is a continuation of application No. 15/262,179, filed on Sep. 12, 2016, now Pat. No. 9,777,489.

(60) Provisional application No. 62/298,159, filed on Feb. 22, 2016.

(51) Int. Cl.

| | |
|---|---|
| ***E04F 17/00*** | (2006.01) |
| ***E03F 5/04*** | (2006.01) |
| ***E03F 5/06*** | (2006.01) |
| ***B66B 13/30*** | (2006.01) |

(52) U.S. Cl.

CPC ..... *E04F 17/00* (2013.01); *B66B 13/301* (2013.01); *E03F 5/0407* (2013.01); *E03F 5/06* (2013.01); *E03F 2005/061* (2013.01); *E04F 17/005* (2013.01)

(58) Field of Classification Search

CPC ..... E04F 17/00; E04F 17/005; E03F 5/0407; E03F 5/06; E03F 2005/061; B66B 13/301

See application file for complete search history.

(56) References Cited

U.S. PATENT DOCUMENTS

| | | | | |
|---|---|---|---|---|
| 2,363,567 A | | 11/1944 | Blakeman | |
| 3,455,059 A | * | 7/1969 | Evans | E02D 29/14 16/263 |
| 4,067,072 A | | 1/1978 | Izzi | |
| D259,950 S | | 7/1981 | Henry | |

(Continued)

FOREIGN PATENT DOCUMENTS

| | | | | |
|---|---|---|---|---|
| EP | 1630309 A1 | | 3/2006 | |
| GB | 2468838 A | * | 9/2010 | E03F 5/06 |

(Continued)

*Primary Examiner* — Bruce W Herring

(74) *Attorney, Agent, or Firm* — Michael Best & Friedrich LLP

(57) ABSTRACT

A trench drain includes a trench, a grating seat and a grating hingedly connected to the trench. The trench has a base wall with peripheral side walls extending upwardly therefrom and an outwardly-extending peripheral flange. The grating seat is configured to receive the grating. The peripheral side walls of the trench have a pair of opposing elongated slots formed therein and the grating has a pair of posts on opposing ends thereof. Each of the pair of posts on the grating are received in a respective one of the pair of opposing elongated slots of the trench to establish an axis of rotation.

14 Claims, 3 Drawing Sheets

(56) References Cited

U.S. PATENT DOCUMENTS 4,541,132 A 9/1985 Long
4,912,349 A 3/1990 Chang
4,964,180 A 10/1990 Harbeke
5,319,812 A 6/1994 Hanrahan et al.
5,324,135 A * 6/1994 Smith ..... E02D 29/1427 210/164
D355,707 S 2/1995 Emanuele et al.
5,864,990 A * 2/1999 Tu ..... E03F 5/06 210/163
5,979,607 A 11/1999 Allen
6,003,169 A 12/1999 Davis, Jr.
6,272,804 B1 * 8/2001 Leis ..... E03F 5/0407 210/164
6,290,143 B1 9/2001 Vincent et al.
6,558,769 B1 * 5/2003 Chwala ..... B32B 3/266 180/69.1
6,941,703 B2 9/2005 MacLean et al.
7,033,489 B2 * 4/2006 Thompson ..... E03F 5/06 210/164
D523,537 S 6/2006 Howard
7,114,872 B2 10/2006 Alba
7,293,937 B2 * 11/2007 Fuchs ..... E02D 29/1427 404/2
7,303,669 B2 * 12/2007 Monneret ..... E02D 29/1427 210/164
7,316,834 B2 1/2008 Hernandez
D582,527 S 12/2008 Wang
7,588,392 B2 9/2009 Wroblewski et al.
7,631,471 B2 12/2009 Grunewald et al.
7,744,304 B2 6/2010 Akkala et al.
8,181,288 B1 5/2012 Davis, Jr.
8,226,824 B2 7/2012 Mondschein et al.
D672,015 S 12/2012 Luke
8,474,068 B2 7/2013 Kik, Sr. et al.
8,505,125 B1 8/2013 Chia et al.
8,549,678 B2 10/2013 Neidich et al.
8,658,033 B2 2/2014 Farkas
8,677,521 B2 * 3/2014 Stimpson ..... A47K 3/40 4/613
8,800,226 B2 8/2014 Bloch
9,010,363 B2 4/2015 Huber
9,027,715 B2 5/2015 Bloch et al.
9,206,593 B2 12/2015 Tripodi et al.
9,382,701 B2 7/2016 Meyers
9,617,723 B2 * 4/2017 Stonecipher ..... E03F 5/06
9,777,489 B2 10/2017 Gomo et al.
10,047,512 B2 * 8/2018 Chromey ..... E03F 3/046
10,240,351 B2 3/2019 Gomo et al.
2004/0238424 A1 * 12/2004 Thompson ..... E03F 5/06 210/163
2004/0256298 A1 12/2004 Curtolo
2005/0230295 A1 * 10/2005 Monneret ..... E02D 29/1427 210/164
2005/0284704 A1 12/2005 Hernandez, Jr.
2006/0171778 A1 * 8/2006 Fuchs ..... E02D 29/1427 404/2
2007/0034577 A1 2/2007 Bayard et al.
2008/0014022 A1 1/2008 Wroblewski et al.
2008/0276368 A1 11/2008 Neidich et al.
2009/0113621 A1 5/2009 DeGooyer et al.
2009/0236293 A1 9/2009 Alvarado
2010/0162481 A1 7/2010 Erlebach
2011/0023978 A1 2/2011 Keizers
2011/0067175 A1 3/2011 Steylaerts et al.
2011/0088161 A1 * 4/2011 Stimpson ..... A47K 3/40 4/613
2011/0139694 A1 6/2011 Mondschein et al.
2011/0162137 A1 7/2011 Kik, Sr. et al.
2012/0031712 A1 2/2012 Bloch et al.
2012/0266968 A1 10/2012 Bloch
2012/0324644 A2 12/2012 Neidich et al.
2013/0098472 A1 4/2013 Farkas
2013/0276226 A1 * 10/2013 Cook ..... A47K 3/40 4/613
2013/0326806 A1 * 12/2013 Stonecipher ..... E03F 5/06 4/613
2014/0230140 A1 8/2014 Davis, Jr.
2014/0262996 A1 9/2014 Alvarado
2014/0352815 A1 12/2014 Brodey et al.
2014/0373943 A1 12/2014 Huber
2015/0240464 A1 8/2015 Meyers
2015/0275498 A1 10/2015 Belanger
2015/0308092 A1 * 10/2015 Chromey ..... E03F 3/046 137/363
2016/0194861 A1 7/2016 Nivelles
2016/0305109 A1 10/2016 Meyers
2016/0309965 A1 10/2016 Berkey
2017/0089331 A1 3/2017 Bialick et al.
2017/0211267 A1 * 7/2017 Stonecipher ..... E03F 5/06
2018/0320357 A1 * 11/2018 Chromey ..... E03F 3/046
2018/0320358 A1 * 11/2018 Chromey ..... E03F 3/046

FOREIGN PATENT DOCUMENTS

JP S52115038 A 9/1977
JP H06227773 A 8/1994
JP H0761743 A 3/1995
JP H1059661 A 3/1998
JP H10324485 A 12/1998
JP 2000219453 A 8/2000
JP 2005082363 A 3/2005
JP 2009196729 A 9/2009
WO 9822381 A1 5/1998
WO 2014012526 A1 1/2014

* cited by examiner

ELEVATOR TRENCH DRAIN

CROSS-REFERENCE TO RELATED APPLICATION

This application is a continuation patent application of U.S. patent application Ser. No. 15/689,896 filed on Aug. 29, 2017, which is a continuation patent application of U.S. Ser. No. 15/262,179 filed on Sep. 12, 2016 and which claims the benefit of U.S. Provisional Patent Application No. 62/298,159 filed Feb. 22, 2016, which are hereby incorporated by reference for all purposes as if set forth in their entirety herein.

STATEMENT OF FEDERALLY SPONSORED RESEARCH OR DEVELOPMENT

Not applicable.

TECHNICAL FIELD

This disclosure relates to drains and, in particular, trench drains for use proximate the threshold of an elevator door to prevent water from flowing down an elevator shaft.

BACKGROUND

Nearly all multi-story buildings are required to have fire prevention systems installed. Such fire prevention systems include water lines and sprinklers which, in the event of the detection of a fire, can distribute large volumes of water in the vicinity of a fire. Such fire prevention systems are particularly of importance in multi-story buildings because, in the event of a fire, there may not be an easy way for firefighters at ground level to get several stories up before the fire has had a chance to spread.

However, it is also often the case that multi-story buildings are not well-equipped to accommodate the drainage of such large volumes of water, especially above ground level. In many instances, if the building includes one or more elevators, then the water provided by the fire prevention system collects on the floors above ground level and may have a tendency to flow down the elevator shaft. Because there is the possibility that both the elevator car and other equipment may exist between the floor and the elevator pit, water drainage into the elevator shaft is to be avoided.

Some drainage systems have been developed to address this problem. See e.g., PCT International Publication No. WO 98/22381 and U.S. Pat. No. 8,800,226. Such systems generally route water laterally into vertical pipes to limit the amount of water entering the open elevator shaft.

SUMMARY

However, the current state of the art drains either need to have great depth to account for the volumes of water that flow therethrough or run the risk of having water overflow from the drain into the elevator shaft.

To prevent draining of water into an elevator and to avoid needing have a deep drain, an improved elevator trench drain is disclosed herein with a low profile that still accommodates high flows of water therethrough. This elevator trench drain may be located at a lower threshold of an elevator door between the floor of the building and the elevator shaft. In this position, any water that collects on the floor (due to, for example, a sprinkler system operating) may be collected in the elevator trench drain and controllably routed to a drainage pipe, rather than simply flowing down into the open elevator shaft. Among other things, this drain can have a low profile, can have a multi-diameter drain opening that builds a head pressure to increase flow out of the drain, and can have a hinged grating for easy installation and access to the trench.

According to one aspect, an elevator trench drain includes a trench and a drain passageway. The trench includes a base wall with peripheral side walls that extend upwardly from the base wall to a trench volume therein. The drain passageway extends downwardly from the base wall of the trench and places the trench volume in fluid communication with a lower opening of the drain passageway (which may be in connection with further drain pipes for routing of the collected water). The drain passageway has a first section proximate the base wall defining a first cross-sectional area and a second section distal the base wall defining a second cross-sectional area. The second cross-sectional area is less than the first cross-sectional area and this reduction from the first cross-sectional area to the second cross-sectional area creates a head pressure that increases the flow out of the lower drain passageway opening during use.

An elevator trench drain of this type may be disposed proximate a lower edge of an elevator door to assist in drainage in the event that water collects on the floor of a multi-story building and to prevent water from draining into the elevator pit in an uncontrolled fashion.

In many forms, the elevator trench drain will have a grating. In some forms, this grating may be hingedly connected to the trench. To provide this hinged connection, the peripheral side walls of the trench may have a pair of opposing elongated slots formed in them and the grating may have a pair of posts on opposing ends thereof. Each of the pair of posts on the grating can be received in a respective one of the pair of opposing elongated slots of the trench to establish an axis of rotation and to permit the assembly/disassembly of the grating to the drain by temporarily axially misaligning the posts relative to the slots. In some forms, the pair of opposing elongated slots may be integrally formed in the peripheral sidewalls of the trench (by welding or casting, for example). It is contemplated that in some forms, each of the slots may positively extend inwardly into the trench from the sidewall. For example, the pair of opposing elongated slots may each be a wall that extends generally perpendicularly from the peripheral side wall of the trench volume and this wall may form a closed loop forming one of the slots into which one of the posts of the grating is received.

With respect to the drain passageway, the first section may have a first distance of downward extension having the first cross-sectional area which is constant along the first distance of downward extension and the second section may have a second distance of downward extension having the second cross-sectional area which is constant along the second distance. In some forms, the first section and the second section may each be tubular and the first and second cross-sectional areas may both be circular. An intermediate section may be between the first section and the second section of the drain passageway in which the intermediate section continuously connects the first section to the second section and reduces in diameter between the two sections. The intermediate section may extend over a distance of downward extension and gradually tapers inward from the first section to the second section. This intermediate section may be frusto-conical but may have other types of taper. For example, the first section and the second section may have vertically-extending walls and the intermediate section may be angled 45 degrees relative to the vertically extending walls as the intermediate section extends downward and inward from the first section to the second section. Alternatively, it is contemplated that the reduction in cross section could occur in a single step or may have alternative angular tapers.

In some forms, the drain passageway may be centrally aligned in the base wall of the trench while, in other forms, the drain passageway may be offset from the center in the base wall of the trench. Such variations may be made depending on the particular structure in which the drain is used.

In some forms, the peripheral side walls of the trench may include two pairs of linear parallel segments such that the trench is rectangular in shape. In some forms, a flange may be disposed outward of the peripheral side walls. Once installed, floor coverings (for example, tile, carpet, and so forth) may cover this flange. In other forms of the drain, this flange may be absent.

In some forms, to provide sufficient head pressure in the drain passageway, a ratio of a diameter of the first section to a diameter of the second section may be 1.5 or may be more generally in a range of 1.4 to 1.6.

In some forms, a depth of elevator trench drain exclusive of the drain passageway may be 1.75 inches. Among other things, this minimizes the height requirement for the installation of the elevator trench drain into the floor (which takes up the inter-story space between adjacent floors). Despite have relatively shallow depth, the drain passageway of the elevator trench drain may be configured to permit the flow of 100 gallons per minute or more of water therethrough.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figures 1, 2:
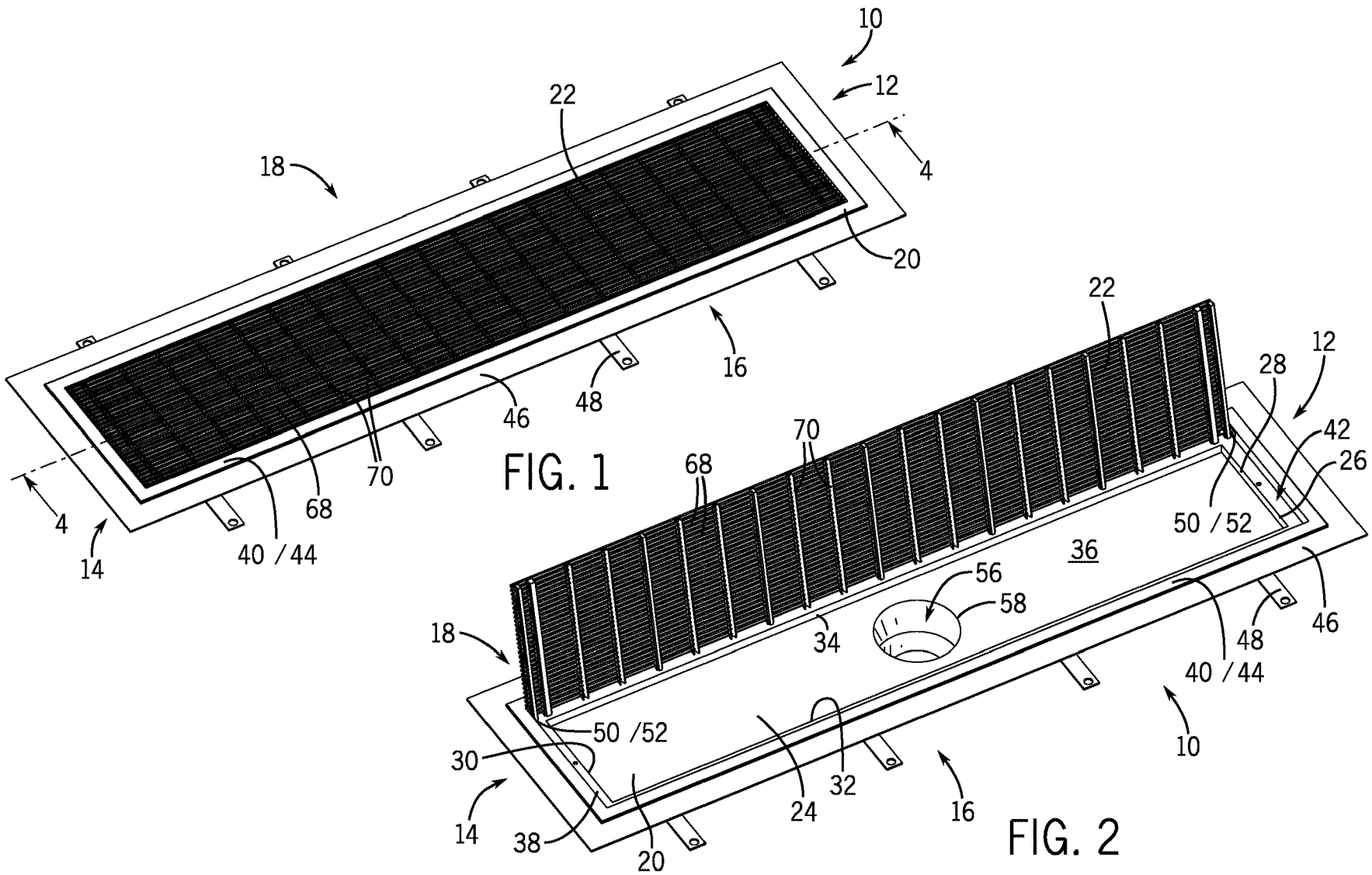
FIG. 1 is a perspective view of an elevator trench drain in which a grating is closed over the trench.
FIG. 2 is a perspective view of the elevator trench drain of FIG. 1 in which a grating is hinged open, revealing the inner volume of the trench and the top side of the drain passageway.

Referring first to FIGS. 1 and 2, an elevator trench drain 10 is illustrated in closed and opened positions, respectively. An elevator trench drain of this type is designed to be installed along the width of the lower edge or threshold of an elevator door. This drain can provide a drainage pathway for fluids, for example water from sprinkler systems. In the absence of such a drain in a situation in which a sprinkler system has been activated, water from the system might collect on the floor and potentially drain into the elevator or elevator shaft. If that were to happen, the elevator system could malfunction in the event of an emergency or be otherwise damaged.

The elevator drain 10 is generally rectangular in the exemplary form shown; however, in other forms, the elevator trench drain 10 may have generally different shapes or aspect ratios which may be custom to the particular application. Because the exemplary elevator trench drain 10 is rectangular, it extends between a pair of lateral ends 12 and 14 which define an overall length of the assembly and extends between a pair of forward and backward ends 16 and 18 which define an overall width of the assembly.

In the illustrated assembly, the elevator trench drain 10 has two main parts including a trench 20 and a grating 22. During use, the water will flow through the grating 22 and collect in the trench 20, though which the water is subsequently drained or evacuated.

The trench 20 has a base wall 24 with peripheral side walls 26 extending upwardly from the base wall 24. Because the particular drain 10 is rectangular, the peripheral side walls 26 include a pair of lateral side walls 28 and 30, a front wall 32, and a rear wall 34. In aggregate, the various walls of the trench 20 defining a trench volume 36 inside the trench 20. In the instant case, this trench volume 36 is generally rectangular in shape being established by the base wall 24, the pair of lateral side walls 28 and 30, the front wall 32, and the rear wall 34.

The various peripheral side walls 26 of the trench 20 also include an inwardly extending step 38 between an upper peripheral lip 40 and the base wall 24 that defines a grating seat 42 for the reception of the grating 22. In the form illustrated, this step 38 occurs approximately halfway between an upper surface 44 of the upper peripheral lip 40 and the base wall 24. During use, water flowing into the trench 20 may also collect (at least to some extent) in the trench volume 36 partially occupied by the grating 22.

The trench 20 may also include features that assist in the installation of the elevator trench drain 10 into the floor, although such features may not be found in all designs. In the particular form illustrated, the trench 20 includes an outwardly-extending peripheral flange 46 that is offset slightly downward from the upper peripheral lip 40. This peripheral flange 46 may receive floor coverings (for it, carpet, tile, cast materials such as concrete) over it such that the top of the floor covering is roughly flush with the upper surface 44 of the upper peripheral lip 40. There may also be anchor straps 48 that extend outwardly past the flange 46 which are employed during the installation of the trench 20 into the surrounding building structure.

Figure 3:
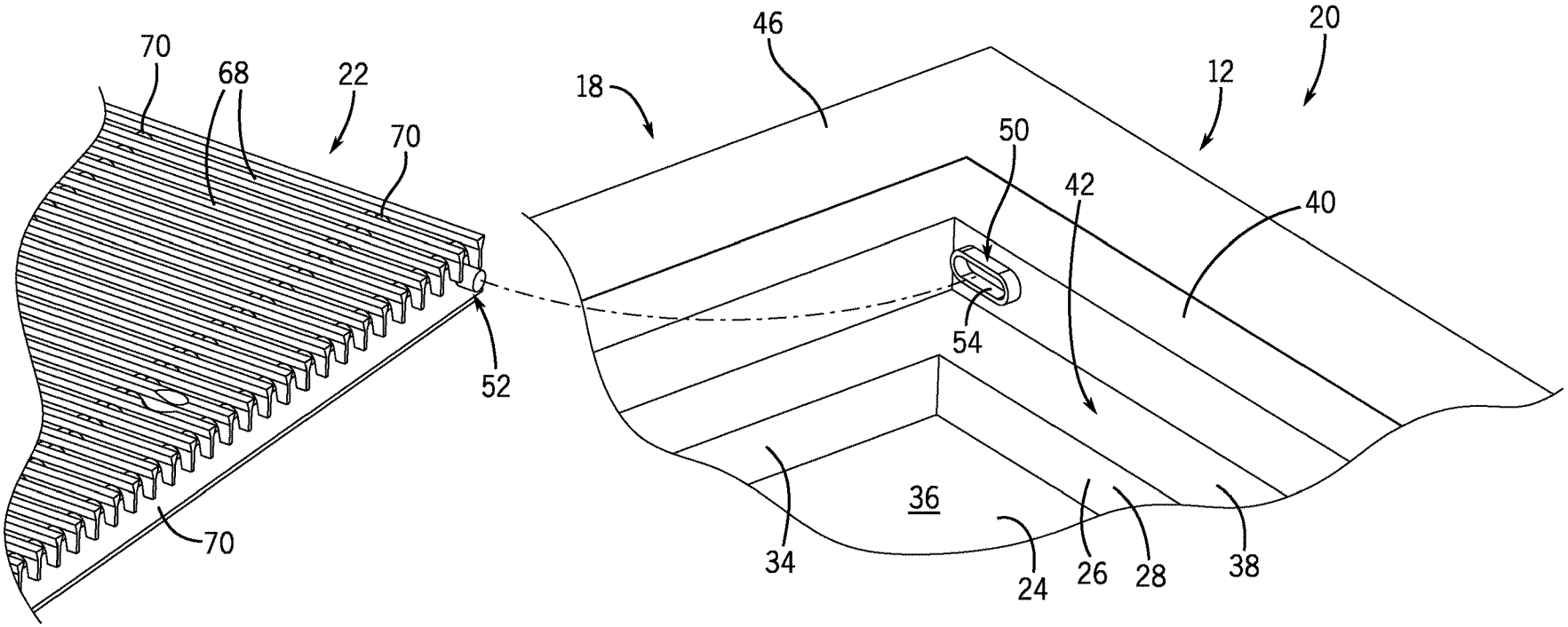
FIG. 3 is a detailed exploded book view of one side the hinge connection between the grating and the trench illustrating how the post of the grating is received in the slot of the trench.

With brief forward reference being made to FIG. 3, to hingedly receive the grating 22 in the trench 20, each of the lateral side walls 28 and 30 may include a slot 50 formed therein such that the slots 50 collectively define a pair of opposing slots. In the particular form illustrated in FIG. 3, the slot 50 is formed above the step 38 in the lateral side walls 28 and 30 proximate the rear wall 34. To accommodate entry of the respective post 52 on the grating 22, these slots 50 are elongated in the front to rear direction such that the grating 22 may be slightly twisted relative the trench 20 and the eventual hinged axis of rotation to provide sufficient clearances for assembly of the posts 52 into the slots 50. In the form illustrated, the slots 50 are integrally formed in the peripheral side walls 26 of the trench 20 and are formed by a wall 54 that extends generally perpendicularly from the peripheral side wall 26 of the trench 20 and forms a closed loop that establishes the slot 50.

Figure 4:
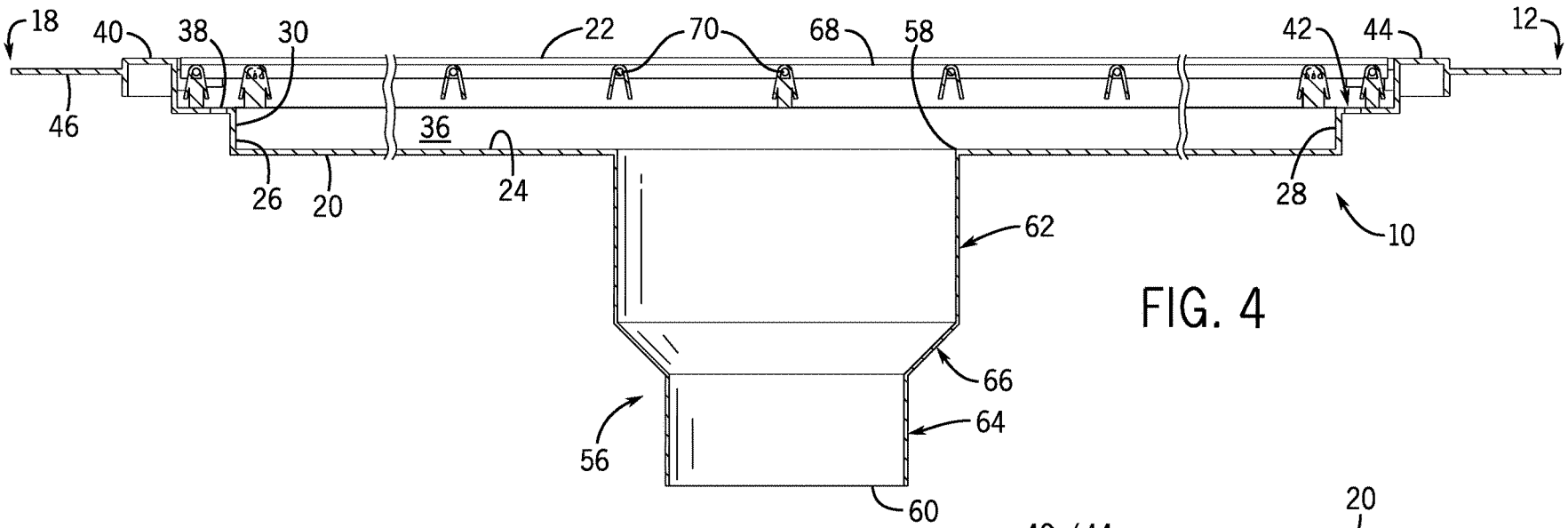
FIG. 4 is a detailed cross-sectional side view of the drain passageway of the elevator trench drain illustrating the reduction in cross-sectional area from the top section to the bottom section of the drain passageway.

With particular reference now being made to FIG. 4, the trench 20 includes a drain passageway 56 that extends downwardly the base wall 24 of the trench 20. As illustrated, the drain passageway 56 is centrally located along the width and length of the trench 20. However, it is contemplated that the drain passageway 56 might be located otherwise such as, for example, at one end of the base wall 24 of the trench 20 or offset from center in one or both of the length and width directions. This drain passageway 56 places the trench volume 36 (at an upper opening 58 formed in the base wall 24) in fluid communication with a lower opening 60 of the drain passageway 56. The lower opening is typically connected in use to a drain pipe such as a 4 inch drain pipe for further routing of the drained water.

Figure 5:
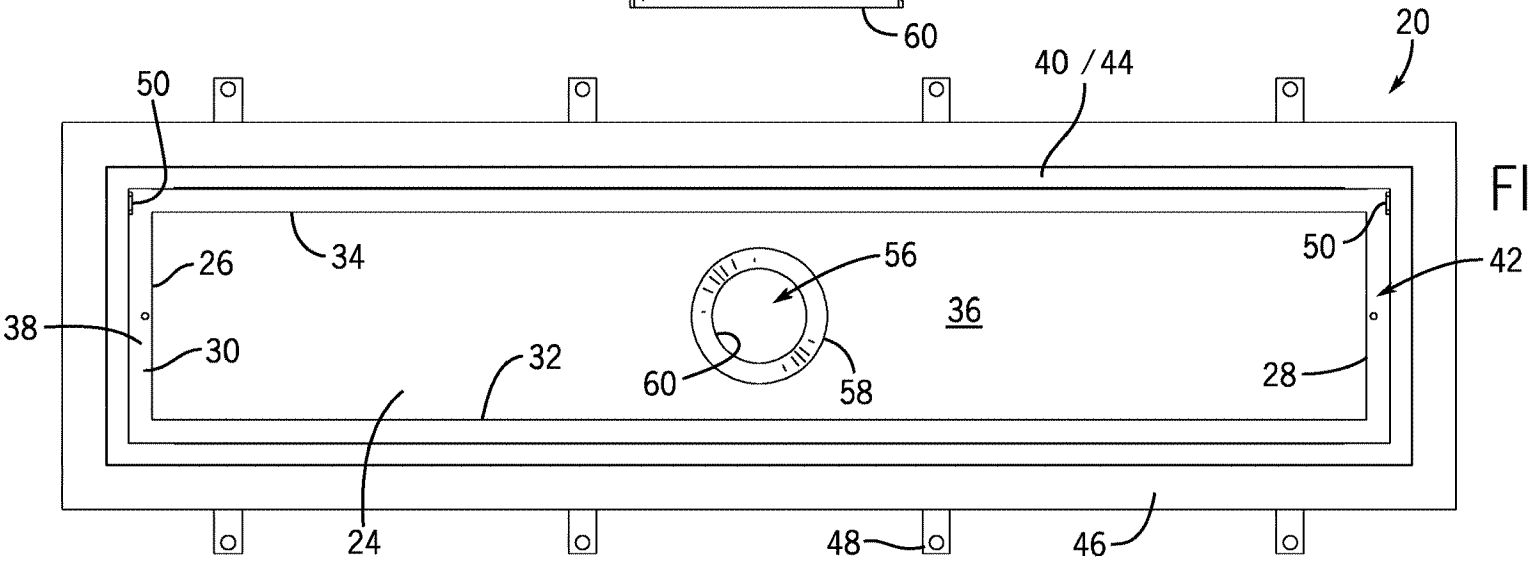
FIG. 5 is a detailed top view of drain passageway further illustrating the profile of the upper and lower sections of the drain passageway as seen from above.

As best seen in FIGS. 4 and 5, the drain passageway 56 has multiple sections as it extends downwardly from the upper opening 58 to the lower opening 60. In the particular form illustrated, there are three sections including an upper section 62 proximate the upper opening 58 in the base wall 24, a lower section 64 proximate the lower opening 60 of the drain passageway 56, and an intermediate section 66 between the upper section 62 and the lower section 64. The upper section 62 and the lower section 64 each have a constant respective cross-sectional area over their axial height or distance of extension. In the illustrated embodiment, the upper section 62 is circular having a diameter of 6 inches and the lower section 64 is circular having a diameter of 4 inches (to match standard drain pipe which is connected to the outlet). The intermediate section 66 between the upper section 62 and the lower section 64 includes an approximately 45 degree taper that transitions the diameter between the respective sections 62 and 64 above and below it. Although the taper is illustrated as extending entirely from the first section to the second section, it is contemplated that there may be more than one differently angled tapered regions or radially extending step in this intermediate section. While circular cross-sections are found in the illustrated design as can be best seen in FIG. 5, it is contemplated that other drain cross sections might also be used if those reduce in cross-section area from the upper section to the lower section.

Among other things, the profile of this drain passageway 56 helps to improve the flow rate of water collecting in the trench 50 through the drain passageway 56. The upper section 62 creates a head pressure which causes the acceleration of the water flowing downward into the lower section 64. Although it is contemplated that the intermediate section 66 might be omitted (i.e., that there could simply be a flat step between sections 62 and 64 which is perpendicular to the central axis of the drain passageway 62), the taper or angling of the intermediate section 66 can further enhance the flow from the upper section 62 to the lower section 64 because it assists in directing the flow of the water in a non-turbulent manner from the upper section 62 into the lower section 64. Among other things, the reduction in diameter to improve and increase flow rate can help enable a low profile (i.e., thin) design so that the elevator trench drain 10 may be installed in smaller spaces without increasing the depth of the floor to accommodate for the drain.

Some exemplary and non-limiting dimensions are now provided for the trench 20. The height of the trench 20 is contemplated as being typically 1.75 inches overall (exclusive of the drain passageway 56), although other depths may also be used depending on the installation context or needs of the customer. A typical width may be 13.5 inches overall with an 11.4375 inch grating seat area. The finished perimeter flange may be approximately 1 inch from the upper peripheral lip 40. The overall length of channel may typically be in a range of 38 to 120 inches. The drain passageway 56 is illustrated as being hydraulically engineered from 6 inches to 4 inches in a funnel style outlet to increase head pressure on the 4 inch section to promote flow (with flow in excess of 100 gallons per minute being targeted in many conditions to meet code and achieved using this passageway structure). This ratio of the diameters from the first section to the second section is approximately 1.5 (6 inches to 4 inches), but it is contemplated that other similar ratios may also be used, for example, in the range of 1.3 to 1.7 or more narrowly in the range of 1.4 to 1.6. The entire trench construction may be provided in Type 304 stainless steel but may also be in Type 316 stainless steel in certain applications or based on customer preference.

The grating 22 is also generally rectangular in shape to match and fit into the grating seat 42 of the trench 20. The exemplary grating 22 includes a plurality of lengthwise-extending bars 68 which are joined to a plurality of widthwise-extending supports 70 to form a grid. However, in other forms, the grating pattern may be different or otherwise embellished to provide a desired aesthetic appearance. On the rear side of the grating 22, there are a pair of oppositely facing posts 52 that are located for reception into the slots 50 of the trench 20 as illustrated in FIG. 3.

As noted above, by angularly twisting the axis of the posts 52 (which are co-axial with one another) they can be slid into the slots 50 of the trench 20 to provide a hinged connection to open the grate as generally illustrated in FIG. 2. There may be some range of motion restrictions depending on the depth of the grating seat 42 and the placement of the posts 52 on the grating 22.

The grating 22 may be a stainless steel wire grating and may be approximately 2 inches shorter than the specified channel length to accommodate installation of the grating 22 into the trench 20 and provide some side clearances. As with the trench 20, the grating 22 may be manufactured from Type 304stainless steel or Type 316 stainless steel. In one exemplary form, the grating 22 may features an open area of 64.9 square inches per linear foot of grating. Wires, bars, and supports may be held by press fit and welded to support trusses (i.e., the bars 68 may be press fit and welded into supports 70 or vice versa). Some gratings may be a fabricated stainless steel slotted grate with an open area of 35.9 square inches per linear foot. In some forms, grating height may be 29/32 inches tall and grating width may be 11.375 inches wide.

Accordingly, an elevator trench drain is disclosed that accommodates high flow rates (up to and exceeding 100 gallons per minute) without having a deep trench depth or necessarily having multiple outlets to accommodate slower flows. The improved drain passageway permits high flow rates without compromising other dimensions of the product or complicating the drain system with additional, multiple fluid connections.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. An elevator trench drain comprising:

a trench having a base wall with peripheral side walls extending upwardly therefrom and an outwardly-extending peripheral flange;

a grating seat disposed between an upper peripheral lip and the base wall; and a grating hingedly connected to the trench;

wherein the grating seat is configured to receive the grating and the peripheral side walls of the trench have a pair of opposing elongated slots formed therein and the grating has a pair of posts on opposing ends thereof and wherein each of the pair of posts on the grating are received in a respective one of the pair of opposing elongated slots of the trench to establish an axis of rotation, and wherein the axis of rotation is movable relative to the trench; and wherein the trench includes a drain passageway extending downwardly therefrom, and wherein the drain passageway is configured to permit the flow of 100 gallons per minute or more of water therethrough.

2. The elevator trench drain of claim 1, wherein axial twisting of the axis of rotation aligns the posts relative to the slots for a hinged connection between the grating and the trench.

3. The elevator trench drain of claim 2, wherein the grating is opened at the hinged connection.

4. The elevator trench drain of claim 1, wherein the grating and the grating seat are rectangularly shaped.

5. The elevator trench drain of claim 1, wherein the grating includes a grid having a plurality of lengthwise extending bards joined to a plurality of widthwise extending supports.

6. The elevator trench drain of claim 5, wherein the grid includes a plurality of shapes formed by the lengthwise extending boards and the widthwise extending supports.

7. The elevator trench drain of claim 1, wherein the grating is made of a stainless steel wire grating.

8. The elevator trench drain of claim 1, wherein the grating includes an open area of grating.

9. The elevator trench drain of claim 8, wherein the open area is 64.9 square inches per linear foot of grating.

10. The elevator trench drain of claim 8, wherein the open area is 35.9 square inches per linear foot of grating.

11. The elevator trench drain of claim 1, wherein the grating has a height of 29/32 inches.

12. The elevator trench drain of claim 1, wherein the grating has a width of 11.375 inches.

13. The elevator trench drain of claim 1, wherein the elongated slots are sized so that the posts can be inserted into and removed from the slots by moving the axis of rotation relative to the trench.

14. The elevator trench drain of claim 1, wherein the trench defines a trench volume, and wherein the slots are at least partially positioned within the trench volume.

* * * * *